United States Patent [19]

Dauphin

[11] Patent Number: 4,641,886

[45] Date of Patent: Feb. 10, 1987

[54] GAS SPRING ARRANGEMENT, ESPECIALLY FOR A BACKREST SUPPORT FOR OFFICE CHAIRS

[75] Inventor: Elke Dauphin, Nuremberg, Fed. Rep. of Germany

[73] Assignee: Burositz Mobelfabrik Friedrich-W. Dauphin GmbH & Co., Offenhausen bei Nürnberg, Fed. Rep. of Germany

[21] Appl. No.: 773,930

[22] Filed: Sep. 9, 1985

[30] Foreign Application Priority Data

Oct. 24, 1984 [DE] Fed. Rep. of Germany ..... 3438843
Mar. 14, 1985 [DE] Fed. Rep. of Germany ..... 3509049

[51] Int. Cl.[4] ..... A47C 1/027

[52] U.S. Cl. ..... 297/300; 297/355; 297/375

[58] Field of Search ..... 297/300, 355, 374, 375

[56] References Cited

U.S. PATENT DOCUMENTS

| | | | |
|---|---|---|---|
| 2,834,402 | 5/1958 | Lautier et al. | 297/320 |
| 3,024,067 | 3/1962 | Brandoli | 297/355 |
| 3,758,092 | 9/1973 | McGregor | 297/355 X |
| 3,893,730 | 7/1975 | Homier et al. | 297/375 |
| 4,200,332 | 4/1980 | Brauning | 297/355 X |
| 4,270,797 | 6/1981 | Brauning | 297/300 |

FOREIGN PATENT DOCUMENTS

| | | | |
|---|---|---|---|
| 2820532 | 11/1979 | Fed. Rep. of Germany | 297/375 |
| 1202658 | 8/1970 | United Kingdom | 297/375 |
| 1430576 | 3/1976 | United Kingdom | 297/300 |

*Primary Examiner*—Kenneth J. Dorner
*Assistant Examiner*—Peter R. Brown
*Attorney, Agent, or Firm*—Browdy and Neimark

[57] ABSTRACT

In a gas spring arrangement, comprising a gas spring disposed between two elements which are pivotable in relation to one another around a pivot axis, which damps the pivot movement, and a mechanical arrangement with an activating lever for the releasable adjustment of the pivot movement, especially for the adjustment of the inclination of the backrest of office chairs, it is provided, on the one hand, to make possible a simple damping of the pivotal movement of the backrest support part relative to the seat carrier and, on the other hand, to make possible the easily operable yet still secure locking of this pivotal movement, that the gas spring (19) is fastened between two transverse struts (bolts 23, 27), each disposed on an element (seat carrier 4, backrest support 7) parallel to the pivot axis (6), that the mechanical adjustment means (29) has a sheath part (31) and a pistion part (30) longitudinally movable in the sheath part (31), that both the sheath part (31) and the piston part (30) are each connected with one of the transverse struts (bolts 23, 27) and are disposed approximately parallel to the gas spring (19), and that the sheath part (31) has a lateral threaded bore (bore 39, threaded top 40), into which a threaded bolt (42) disposed at the front end of the activating lever (43) can be screwed in such a way, that the piston part (30) can be braced against the sheath part (31).

5 Claims, 3 Drawing Figures

GAS SPRING ARRANGEMENT, ESPECIALLY FOR A BACKREST SUPPORT FOR OFFICE CHAIRS

FIELD OF THE INVENTION

The invention relates to a gas spring arrangement comprising a gas spring disposed between two elements pivotable in relationship to each other around a pivot axis, which damps the pivot movement, and a mechanical arrangement with an actuating lever for the releasable adjustment of the pivot movement, for changing the inclination of the backrest of office chairs.

BACKGROUND OF THE INVENTION

Gas spring arrangements of this kind are used especially to damp the pivotal movement of the back rest support, or of the backrest or, possibly combined with this, of the seat. To permit the user of such office chairs to either fix the inclination of the backrest or the seat in a desired position or to maintain the backrest of the seat pivotable, so that they can follow the movements of the body, it is known to provide releasable adjustment means to arrest the pivotal movement. Such adjustment means, when used with longitudinally adjustable gas springs, can either act directly upon the gas spring or it is possible to provide a separate mechanical adjustment means in addition to the gas spring. Such mechanical adjustment means have the advantage that more cost-effective gas springs can be used.

Two competing demands on such gas spring arrangements result from this particular problem. On the one hand, the adjustment means should make possible an absolutely secure fixing of, for instance, the seat or the backrest, in a desired position of inclination in spite of the comparatively high torque which occurs. On the other hand, the adjustment means should be operable with ease to assure trouble-free operation. In addition, care must be taken that the adjustment means in the released position does not hinder the pivoting movement, but only damps it by means of the gas spring.

SUMMARY OF THE INVENTION

On the basis of the foregoing, an object of the present invention is to provide a gas spring arrangement of the aforementioned type in a form which provides dependable adjustment with easy releasability, at the same time providing a construction which is as simple as possible while being safe to operate as well as being low-cost.

This is accomplished by providing a construction characterized in that a gas spring is fastened between two transverse struts or bolts which are each disposed on an element, e.g. a seat carrier and backrest support part, parallel to the pivot axis between these two elements, and in that the mechanical adjustment means comprises a sheath part and a piston part longitudinally movable in the sheath part, in that the sheath part and the piston part are connected to one of the transverse struts or bolts and are disposed generally parallel to the gas spring, and in that the sheath part has a lateral threaded bore into which a threaded bolt disposed at the front end of an activating lever can be screwed in such a way that the piston part can be braced against the sheath part.

The parallel arrangement of interlocking sheath and piston parts with the gas spring makes it possible to create a laminar compression between the sheath part and the piston part by bracing one against the other through a tightening of the threaded bolt, thereby making possible a strong adjusting force, remaining constant even with frequent activation. Furthermore, no additional fastening means need be provided for the adjustment means, the transverse struts needed for fixing the gas spring in place can be used for this purpose.

In an embodiment wherein the sheath and piston parts have rectangular cross-sections, it is possible to achieve an especially strong laminar compression.

By means of the production steps wherein the sheath part and the piston part are fastened with axial free play to the transverse struts or bolts, it becomes possible to brace the piston part and the sheath part against one another without problems and that, while the adjustment means are in their unlocked state, the free pivot movement is not hindered by seizing.

The embodiment characterized in that a detent or limiting sheath is disposed on the transverse strut or bolt supporting the piston part, which limits its axial movement in the direction of the gas spring, makes it possible that in spite of the axial free play provided, the detent keeps the sheath and piston parts in place, especially when the activating lever is used.

By means of the construction wherein a spring or spring clip is disposed on the transverse strut or bolt supporting the sheath part which acts on the latter parallel to the pivot axis, it becomes easily possible to avoid uncontrolled axial play, which would lead to an undefinable position of the activating lever, while still maintaining the desired axial free play.

The embodiment characterized in that the spring is formed approximately as a U-shaped spring clip makes it possible to use a very simple and therefore cost-effectively producable spring.

The construction wherein open fastening indentations are disposed at the ends of the legs of the spring clip makes possible a very simple installation of the spring.

Further characteristics, advantages and details of the present invention can be seen from the following description of a preferred embodiment by means of the drawings.

DESCRIPTION OF THE PREFERRED EMBODIMENT

Figure 1:
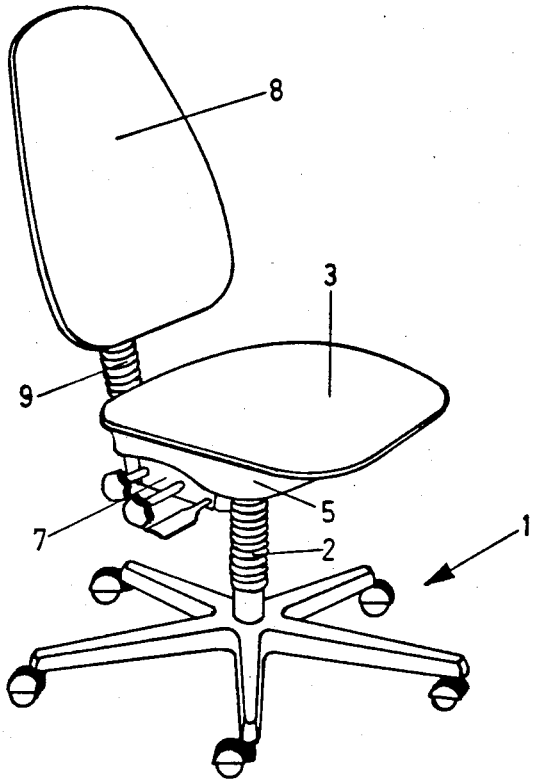
FIG. 1 is a schematic side view of an office chair.
Figure 2:
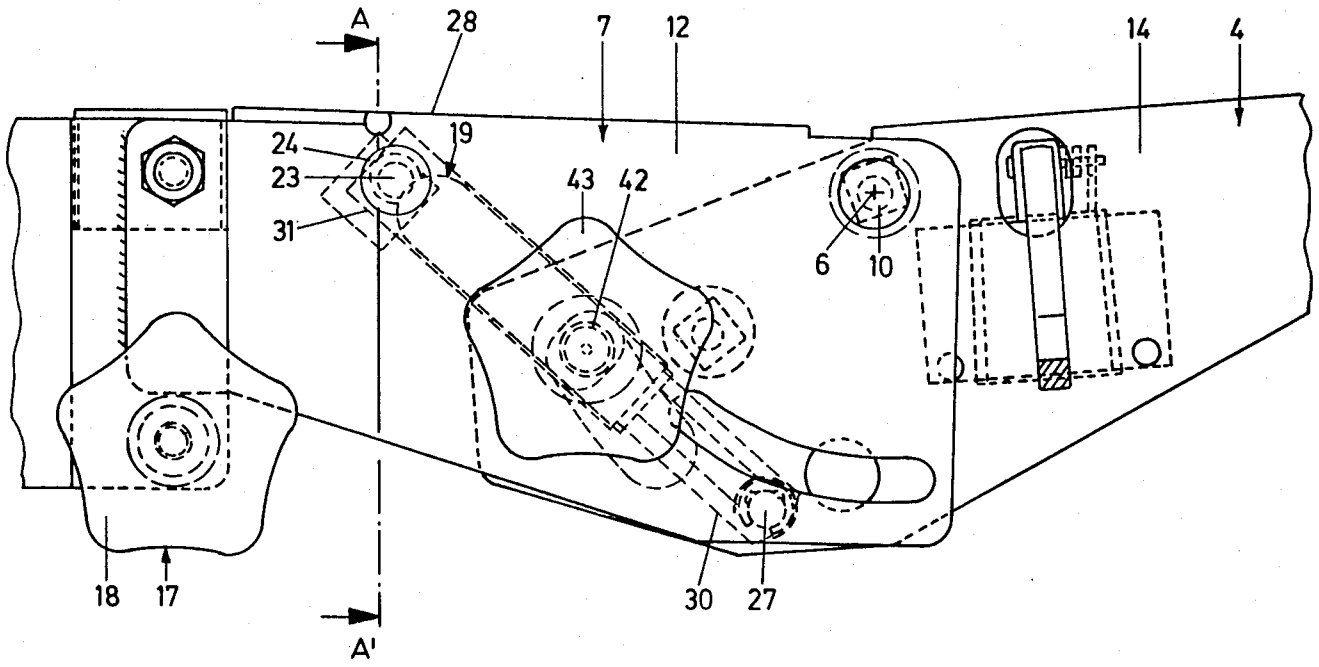
FIG. 2 is a side view of the linkage area of the seat carrier with the base frame.

An office chair, shown in FIG. 1, consists of a base 1 with a support column 2, which is connected with a seat carrier 4 containing the cushioned seat 3. The outer covering 5 of the seat carrier 4 only is shown in FIG. 1.

A backrest support part 7 is connected to the seat carrier 4 pivotably around a pivot axis 6, and the backrest support column 9 supporting the backrest 8 is connected to the backrest support part 7.

The seat 3 is connected in an articulated manner, not shown in detail, to the front end of the seat carrier 4 on the one hand and to the backrest support part 7 on the other. The articulated connection between the seat carrier 4 and the backrest support part 7 is furnished by means of a pivot bolt 10, which passes through the side walls 11, 12 and 13, 14 of the backrest support part 7 and the seat carrier 4, respectively. The backrest support part 7 and the seat carrier 4 are each of a U-shaped cross section, wherein the transverse parts 15, 17 of the U point upwards, i.e. towards the seat. A releasable fastening means 17 for the backrest support column is provided at the rear end of the backrest support part 7.

A gas spring 19 is provided for the damping of the pivotal movement of the backrest support part 7 around the axis 6. The housing end 20 of the gas spring 19 is provided against the backrest support part 7 and is pivotably fastened on a bolt 23 by means of an annular sheath 22 fastened to gas spring housing 21. The bolt 23 pierces the walls 11, 12 of the backrest support part 7 and is fastened by means of the bolt heads 24.

The piston 25 is connected with an annular sheath 26, which performs a spacing function and is pivotably disposed on a bolt 27, acting as a transverse strut, and which pierces the side walls 13, 14 of the seat carrier 4 and is fastened there. The bolt 23 is disposed in the area of the upper edge 28 of the backrest support part 7, while the bolt 27 is disposed in the area of the lower edge of the seat carrier 4 below the pivot bolt 10, wherein the bolts 23, 27 are in such a position relative to one another that the gas spring 19 forms an angle of about 30° to 45° to the level of the seat 3. This makes it possible to cushion the movement of the backrest 8 in relation to the seat carrier 4 without necessitating the employment of additional counter-springs to make possible the retrograde movement of the seat back.

Figure 3:
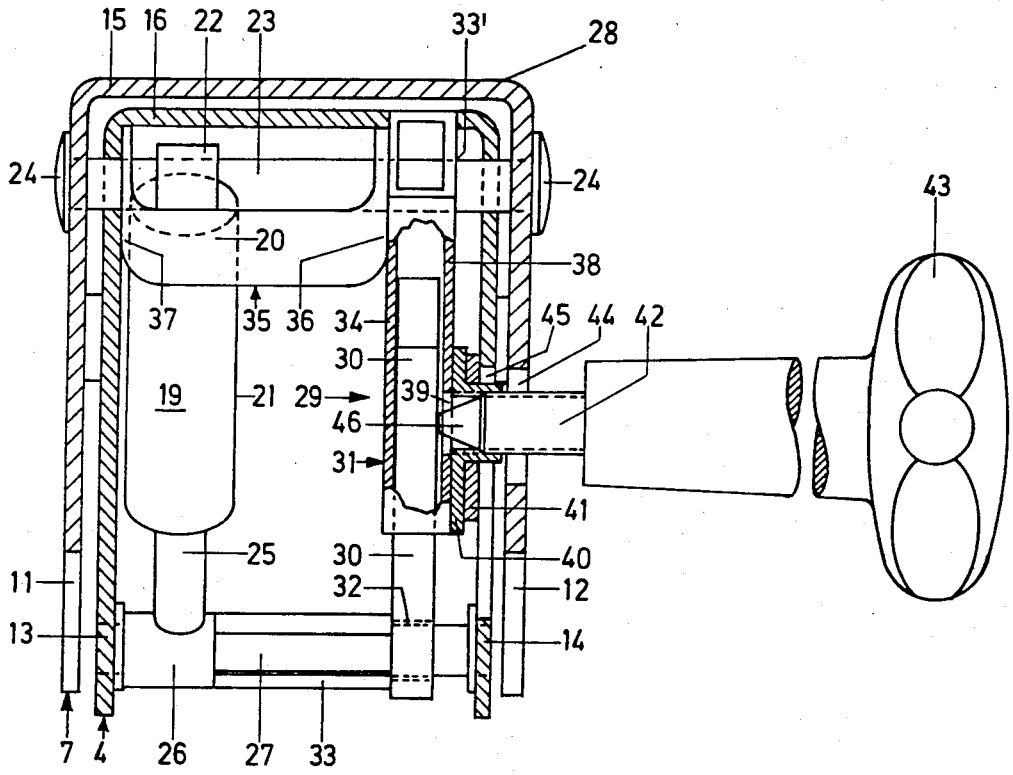
FIG. 3 is a section along the line A—A' in FIG. 2.

The adjustment means 29 is disposed generally parallel to the gas spring 19. It comprises a piston part 30 and a sheath part 31, shown partially cut away in FIG. 3. The piston part 30 and the sheath part 31 are rectangular in cross section, wherein the piston part 30 extends longitudinally movable into the sheath part 31. The piston part 30 has a bore 32, through which the bolt 27 penetrates. A limiting sheath 33 keeps the piston part 30 at a predetermined minimal distance from the annular sheath 26 and thereby from the gas spring 19.

The sheath part 31 also has a bore 33', penetrated by the bolt 23. A U-shaped spring clip 35 abuts with its leg 36 against the inside of the sheath part 31, while its other leg 37 is supported against the inside of the side wall 13.

The outside 38 of the sheath part 31 has a bore 39. A threaded top 40 is welded on in the area of the bore 39 and is enclosed by a plastic spacer 41. A threaded bolt 42 is screwed into the threaded top 40, on the rear part of which is fastened an activating lever 43. The threaded bolt 42 penetrates a bore 44 in the side wall 12 and an indentation 45 of about the shape of a segment of a circle, which permits a free pivotal movement.

The gas spring arrangement in accordance with the present invention operates in such a way that, with the threaded bolt 42 loosened, a free pivotal movement between the backrest support part 7 and the seat carrier 4 becomes possible, which movement is damped by the gas spring 19 in such a way that there is no necessity for a counter-spring for the return of the backrest 8. By the movement of the activating lever 43 the threaded bolt 42 is screwed into the threaded top 40, the front end 46 of the threaded bolt 42 presses against the piston part 30 which, in turn, presses against the inside of the sheath part 31 and laminarly compresses the piston part 30 there in such a way that, in spite of only a small turning movement required for the activation of the lever 43, an absolutely dependable fixation of the backrest adjustment becomes possible.

The foregoing relates to a preferred exemplary embodiment of the invention and it is understood that other variants and embodiments thereof are possible within the spirit and scope of the invention.

What is claimed is:

1. A gas spring arrangement comprising a gas spring, disposed between two elements pivotable in relation to one another around a pivot axis, which damps the pivot movement, and a mechanical arrangement with an activating lever for the releasable adjustment of the pivot movement, especially for the inclination adjustment of the backrest of office chairs, characterized in that the gas spring is fastened between two transverse struts, which are each disposed on an element parallel to the pivot axis, and in that the mechanical adjustment means comprises a sheath part and a piston part longitudinally movable in the sheath part, in that the sheath part and the piston part are each connected with axial free play to one of the transverse struts and are disposed generally parallel to the gas spring, and in that the sheath part has a lateral threaded bore, into which a threaded bolt disposed at the front end of the activating lever can be screwed in such a way that the piston part can be braced against the sheath part, and a spring is disposed on the transvere strut supporting the sheath part, said spring acting on said sheath part parallel to the pivot axis.

2. A gas spring arrangement in accordance with claim 1, characterized in that the sheath part (31) and the piston part (30) are formed with a rectangular cross section.

3. A gas spring arrangement in accordance with claim 1, characterized in that a detent is disposed on the transverse strut supporting the piston part, which limits its axial movement in the direction of the gas spring.

4. A gas spring arrangement in accordance with claim 1, characterized in that the spring is formed approximately as a U-shaped spring clip.

5. A gas spring arrangement in accordance with claim 4, characterized in that open fastening indentation, are disposed at the ends of the legs (36, 37) of the spring clip.

* * * * *